US006913032B2

(12) United States Patent
Kronenbitter

(10) Patent No.: US 6,913,032 B2
(45) Date of Patent: Jul. 5, 2005

(54) SANITARY FAUCET UNIT

(75) Inventor: Bernd Kronenbitter, Zell (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/333,931

(22) PCT Filed: May 29, 2002

(86) PCT No.: PCT/EP02/05881

§ 371 (c)(1),
(2), (4) Date: Apr. 18, 2003

(87) PCT Pub. No.: WO02/097202

PCT Pub. Date: Dec. 5, 2002

(65) Prior Publication Data

US 2004/0019966 A1 Feb. 5, 2004

(30) Foreign Application Priority Data

May 29, 2001 (DE) ..... 101 25 981

(51) Int. Cl.[7] ..... E03C 1/02

(52) U.S. Cl. ..... 137/218; 137/360; 137/597

(58) Field of Search ..... 137/218, 360, 137/597

(56) References Cited

U.S. PATENT DOCUMENTS

| | | | | | |
|---|---|---|---|---|---|
| 4,572,232 | A | * | 2/1986 | Gruber | 137/360 |
| 5,095,554 | A | | 3/1992 | Gloor | |
| 5,947,147 | A | * | 9/1999 | Gnauert et al. | 137/218 |

FOREIGN PATENT DOCUMENTS

| | | |
|---|---|---|
| DE | 2401869 | 7/1975 |
| DE | 8708817 | 10/1987 |
| DE | 29605336 | 6/1996 |
| DE | 19636851 | 3/1998 |
| EP | 0455998 | 4/1991 |
| EP | 0818585 | 7/1997 |
| EP | 0818586 | 7/1997 |

OTHER PUBLICATIONS

German Search Report.
PCT Search Report.

* cited by examiner

*Primary Examiner*—Gerald A. Michalsky
(74) *Attorney, Agent, or Firm*—Duane Morris LLP

(57) ABSTRACT

A sanitary fitting block constructed for concealed fitting contains water pipes for hot and cold water and also for mixed water. Between a mixer cartridge to be connected to the sanitary fitting block and a switching means for a shower outflow is provided a return flow preventer and between the switching means and the bath outflow is provided a vent.

14 Claims, 2 Drawing Sheets

SANITARY FAUCET UNIT

Figure 1:
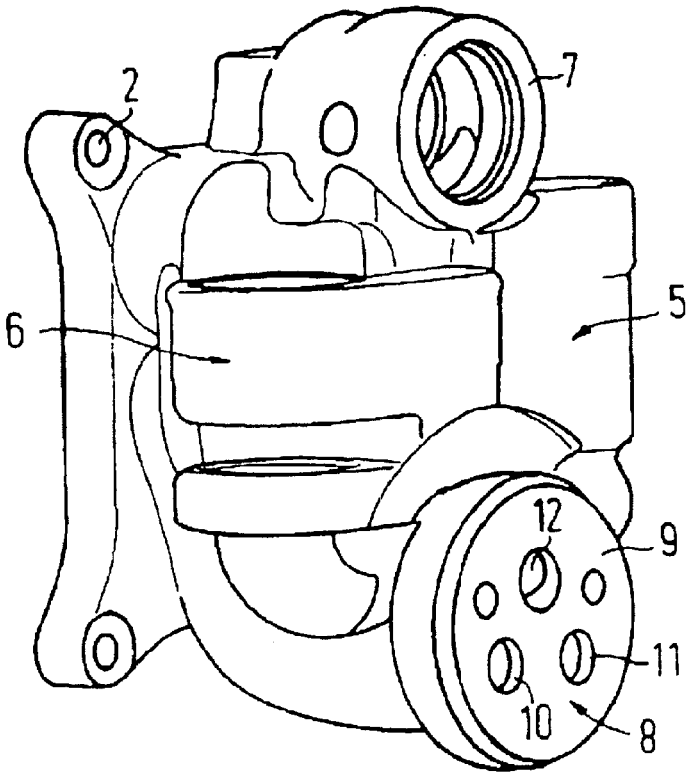

The invention relates to a sanitary fitting block, which is connected in the case of a house installation in normally concealed manner to hot and cold water supply pipes and in or on which can be housed functional parts of the fittings, e.g. a mixer cartridge or a switching means for switching the mixed water outlet between a bath outflow and a shower outflow.

A concealed connecting piece of this type is already known (EP-A2-818585). In this known connecting piece a vent in the form of a multiway valve is located in a hole emanating from a connecting face for a mixer cartridge.

A concealed fitting is also known (EP-A2-818586), in which a reflux preventer is positioned in a face emanating from a connecting surface for a mixer cartridge.

A sanitary fitting is also known (EP-A1-455998), in which a securing device is placed in a hole. In successively connected manner the securing device contains a return flow preventer and a vent, both being located in the same receptacle.

The problem of the invention is to provide a sanitary fitting block which, in the case of easy manufacture and simple construction, can be easily maintained and fulfils all safety requirements.

For solving this problem a sanitary fitting block is provided according to the present invention.

The sanitary fitting block proposed by the invention consequently contains a return flow preventer positioned downstream of the mixed water outlet of the mixer cartridge, together with a vent, which is also positioned downstream of the mixed water outlet of the mixer cartridge.

The mixer cartridge need not be directly located in the sanitary fitting block. It is also possible for there to be an optionally planar surface having the water outlet ports and water inlet ports for the mixer cartridge. The port associated with the mixed water outlet from the mixer cartridge is considered in the above description to be the mixed water outlet of the mixer cartridge.

It is also possible for the sanitary fitting block to have a recess in which the mixer cartridge is inserted.

It can in particular be provided that the return flow preventer and the venting device or vent are functionally connected in series and therefore mutually reinforce their action.

It can in particular be provided that the vent is positioned between the return flow preventer and the mixed water outlet from the sanitary fitting block.

According to a further development of the invention the sanitary fitting block has a receptacle for a switching valve, which switches between the first mixed water outlet from the sanitary fitting block and a second mixed water outlet from the sanitary fitting block.

It can in particular be a so-called shower switching means. One mixed water outlet from the sanitary fitting block can be associated with a bath outflow, whereas the second mixed water outlet from the sanitary fitting block is then associated with a shower outlet.

The return flow preventer can be positioned between the connection for the mixer cartridge and the switching valve. The return flow preventer is a check valve, which in the case of a vacuum in the supply pipes prevents a sucking back. With the arrangements described here both the sucking back from the shower outflow and from the bath outflow is prevented.

According to a further development of the invention the vent is located between the switching means and the bath outflow. Particularly if the bath outlet is located below the upper edge of a bath, so that in the least favourable case it is located below the water surface, considerable safety and security can result from this vent arrangement.

According to a further development of the invention the chamber in which the return flow preventer is located is subject to an axial inflow and/or a lateral outflow.

It is also possible according to the invention for the chamber in which the vent is located to be subject to a lateral inflow and/or an axial outflow.

The term lateral inflow and lateral outflow can mean both a radial and also a tangential direction with respect to a normally cylindrically constructed return flow preventer or vent.

According to the invention the water inlet and air inlet are arranged in substantially axially displaced, facing manner. The vent and/or return flow preventer are subject to an axial through-flow. The vent ports are radially positioned.

The invention proposes that the return flow preventer and/or the vent are constructed as cartridges and/or are located in separate receptacles. Thus, not only can they be individually inserted and removed, but can also be individually interchanged.

The invention more particularly proposes that the return flow preventer and/or vent are secured in their receptacles by plugs, particularly screw plugs. The receptacles can be constructed in cylindrical recess form, in which the corresponding element is inserted and is fixed there by the screw plug.

According to a further development of the invention the chambers for the return flow preventer and the vent are arranged in parallel.

According to the invention the receptacles for the return flow preventer and/or for the vent are positioned in such a way that the return flow preventer and/or vent can be replaced without removing the mixer cartridge and/or without removing the switching valve. This makes maintenance particularly easy, because the replacement of an element is particularly simple. It is merely necessary to remove the plug or also a screw plug and then the elements can be extracted and replaced. The plugs are preferably located on the same side.

According to the invention the connection for the mixer cartridge and optionally the receptacle for the switching means can be located on opposite sides of the front of the fitting block, e.g. at the top and bottom.

According to the invention the inlet connections and/or outlet connections issue or exit on a planar back of the sanitary fitting block.

Further features, details and advantages of the invention can be gathered from the following description of a preferred embodiment, the claims and abstract, whose wording is by reference made into part of the content of the description, together with the attached drawings, wherein show:

FIG. 1 A perspective view of a sanitary fitting block according to the invention.

Figure 2:
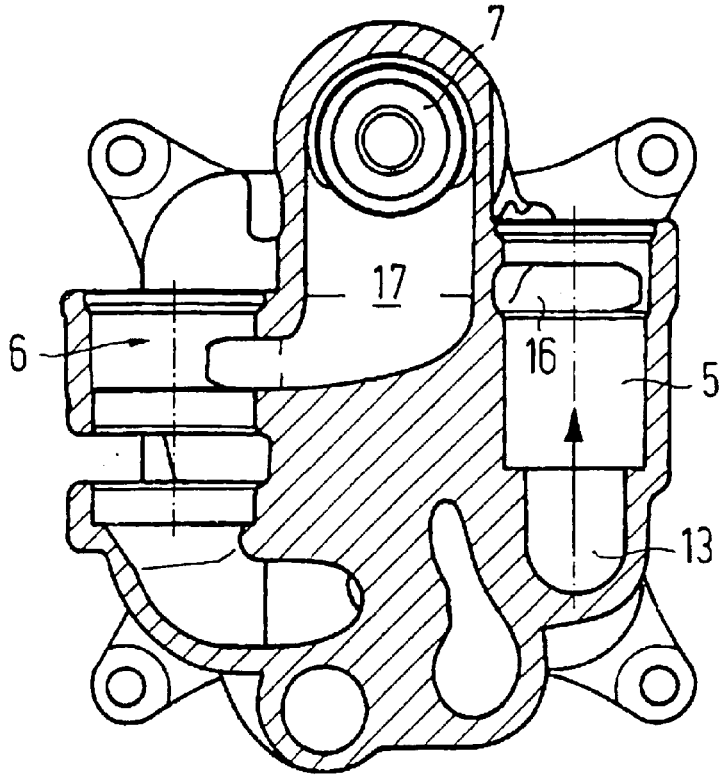

FIG. 2 A section through the sanitary fitting block.

Figure 3:
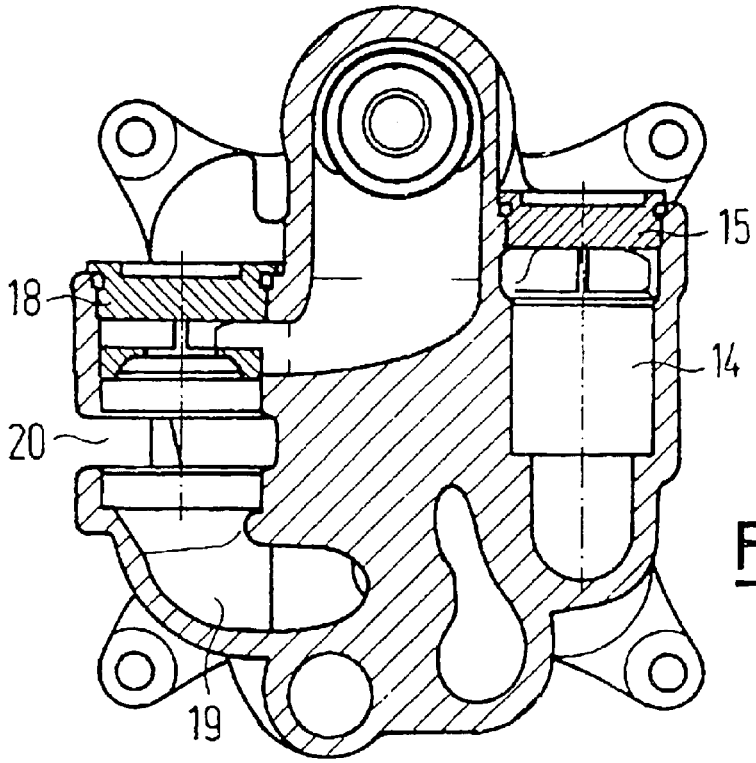

FIG. 3 A section corresponding to FIG. 2 with the return flow preventer inserted.

Figure 4:
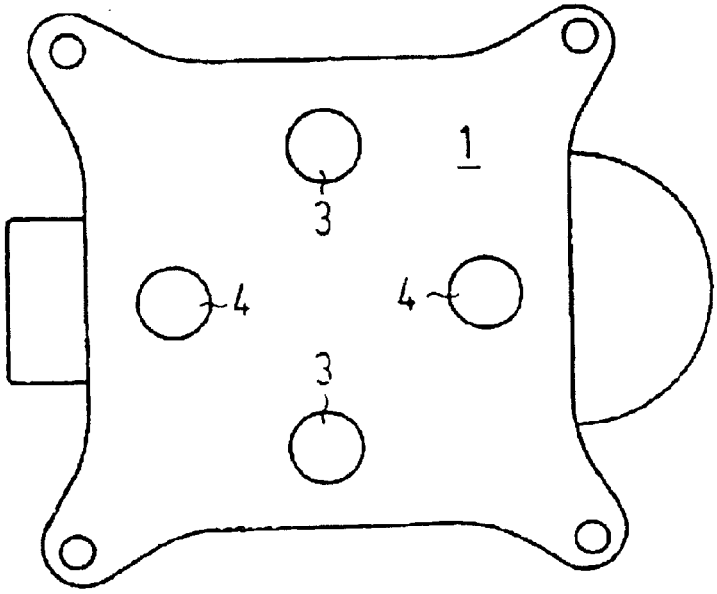

FIG. 4 A view from the rear of the sanitary fitting block.

The sanitary fitting block shown in the drawings is intended to be fixed in concealed or flush manner to a wall. As can be seen in FIG. 4, its back is formed by a plate forming a planar surface. At each of the four corners is provided a hole 2 running perpendicular to the back 1 and through which the sanitary fitting block can be screwed to a wall. As can be seen in FIG. 4, in said back 1 into the sanitary fitting block issue two inlet ports 3, whereof one is intended for the cold water pipe connection and one for the hot water pipe connection. In addition, into the back 1 issue two ports 4, whereof one is connected to a further extending pipe for a bath outflow, whilst the other is connected to a further extending pipe for a shower, e.g. a fixed mounted head shower or a connection for a shower hose.

In its front region the sanitary block contains a receptacle 5 for a return flow preventer and in parallel thereto a receptacle 6 for a vent. Both receptacles are parallel to one another and are positioned laterally on the sanitary fitting block. On the two other sides, i.e. at the top and bottom in FIG. 1, is provided a receptacle 7 for a switching means and facing the same a receptacle 8 for a mixer cartridge. The receptacle 8 for a mixer cartridge is formed by a planar surface, in which are located both through openings for water and also screwing holes provided with an internal thread. From the ports 3, 4 issuing into the back of the sanitary fitting block ducts pass through the interior of the block and form the corresponding water connections. Into the surface 9 for the connection of the mixer cartridge shown in FIG. 1 issues an opening 10 for the hot water and an opening 11 for the cold water. The surface 9 contains a further opening 12 through which the mixed water leaving the mixer cartridge re-enters the sanitary fitting block. It is therefore a mixed water outlet port of the mixer valve.

From said mixed water outlet port 12 a duct within the sanitary fitting block leads to the lower end 13 of the receptacle 4 for the return flow preventer (cf. FIGS. 1 to 3). The section in FIG. 2 is placed through the axis of the receptacles 5 and 6. The duct from the mixed water outlet port 12 to the lower end 13 of the receptacle S is located above the sectional plane. In accordance with FIG. 3, into the upper, open end of the receptacle 5 is inserted a return flow preventer and the upper end is closed with the aid of a screw plug 15, which is also sealed with respect to the receptacle. The water passes out of the receptacle 5, into which it axially flows, in lateral manner through a slot 16 into the receptacle 7 for the shower switching means. Said duct leading out of the slot 16 is located below the sectional plane of FIGS. 2 and 3.

As a function of the setting of the subsequently acting shower switching means, water for the shower switching means passes out of the receptacle 7 either directly to one of the outlet ports 4 in the back of the sanitary fitting block or through the slot 17 located in the sectional plane of FIG. 2. From the slot 17 it passes laterally into the receptacle 6 for the vent, which in similar manner to the return flow preventer 14 is inserted in the receptacle and secured with the aid of a screw plug. From the vent receptacle 6 the water passes axially through a further extending duct 19, cf. FIG. 3, into the outlet port for the bath outflow issuing from the back 1 of the sanitary fitting block, cf. FIG. 1.

The water flow is as follows. The hot and cold water pass through the corresponding inlet ports 3 through the sanitary fitting block to the corresponding openings 10 and 11 in surface 9, where the mixer cartridge is fitted. The mixed water passes from the mixer cartridge through the opening 12 into the duct and flows axially into the return flow preventer 14, from where it passes laterally, i.e. either radially or tangentially, into the receptacle 7 for the shower switching means. From there the water can either pass through the vent to the bath outflow, or directly to the shower hose.

Both the return flow preventer 14 and the vent can, without removing the mixer cartridge, merely following the removal of a cover or a rose, be removed from the corresponding receptacles 5, 6 and it is only necessary to remove the corresponding screw plugs. There is also no need to remove the shower switching means in order to permit access to the two elements.

In the case of back suction, i.e. if the bath outflow is under water, the mixed water cartridge is opened and there is a vacuum in the supply pipe, any back suction is prevented by the combination of return flow preventer 14 and vent. Initially the pipe is blocked by the return flow preventer and in the case of further vacuum the vent opens an opening, so that air can pass through the lateral slot 20 in the sanitary fitting block and from there into the pipe.

What is claimed is:

1. A sanitary fitting block, comprising:

an inlet connection for cold water, an inlet connection for hot water, a connection for a mixer cartridge, at least one outlet connection for mixed water, a return flow preventer which is positioned between the mixer cartridge connection and the mixed water outlet connection, a vent which is positioned between the mixer cartridge connection and the mixed water outlet connection; and, wherein the vent is positioned between the return flow preventer and the mixed water outlet connection from the sanitary fitting block.

2. The sanitary fitting block according to claim 1, with a receptacle for a switching valve, which switches between said mixed water outlet of the sanitary fitting block and a second mixed water outlet from the sanitary fitting block.

3. The sanitary fitting block according to claim 2, wherein the return flow preventer is positioned between the mixer cartridge connection and the switching valve.

4. The sanitary fitting block according to claim 2, wherein the vent is positioned between the switching valve and the mixed water outlet connection from the sanitary fitting block leading to a bath.

5. The sanitary fitting block according to claim 2, wherein the mixer cartridge connection and the receptacle for the switching valve are positioned on opposite sides of a front of the sanitary fitting block.

6. The sanitary fitting block according to claim 1, wherein a chamber of the return flow preventer is subject to at least one of an axial inflow and a lateral outflow.

7. The sanitary fitting block according to claim 1, wherein a chamber of the vent is subject to a lateral inflow and axial outflow.

8. The sanitary fitting block according to claim 1, wherein at least one of the return flow preventer and the vent are one of constructed as a cartridge, and structured for placement in separate receptacles.

9. The sanitary fitting block according to claim 8, wherein the receptacles for the return flow preventer and the vent are positioned in such a way that at least one of the return flow preventer and the vent can be disassembled without removing the mixer cartridge.

10. The sanitary fitting block according to claim 1, wherein at least one of the return flow preventer and the vent is axially fixed in a given receptacle therefor.

11. The sanitary fitting block according to claim 10, wherein for fixing, use is made of one of a plug and a screw plug.

12. The sanitary fitting block according to claim 10, wherein the receptacle for the vent and the water inflow to the receptacle for the return flow preventer face one another.

13. The sanitary fitting block according to claim 1, wherein the return flow preventer and the vent are arranged parallel to one another.

14. The sanitary fittng block according to claim 1, wherein at least one of the inlet connections and outlet connections issue onto a planar back of the sanitary fitting block.

* * * * *